US010011999B2

(12) United States Patent
Tchakarov et al.

(10) Patent No.: US 10,011,999 B2
(45) Date of Patent: Jul. 3, 2018

(54) METHOD FOR FINISHING A SURFACE USING A GROUTING PAN

(71) Applicant: DIAMOND TOOL SUPPLY, INC., Monroe, MI (US)

(72) Inventors: Tchavdar V. Tchakarov, Monroe, MI (US); Eric Gallup, Rochester Hills, MI (US); Robert James Michielutti, St. Clair Shores, MI (US)

(73) Assignee: Diamond Tool Supply, Inc., Monroe, MI (US)

( * ) Notice: Subject to any disclaimer, the term of this patent is extended or adjusted under 35 U.S.C. 154(b) by 0 days.

(21) Appl. No.: 15/436,923

(22) Filed: Feb. 20, 2017

(65) Prior Publication Data

US 2017/0175406 A1 Jun. 22, 2017

Related U.S. Application Data

(62) Division of application No. 14/490,012, filed on Sep. 18, 2014, now Pat. No. 9,580,916.

(51) Int. Cl.

| | |
|---|---|
| ***E04F 21/24*** | (2006.01) |
| ***E01C 19/21*** | (2006.01) |
| ***E04F 21/16*** | (2006.01) |
| ***B05D 1/00*** | (2006.01) |
| *E04F 15/12* | (2006.01) |

(52) U.S. Cl.
CPC ..... *E04F 21/245* (2013.01); *B05D 1/002* (2013.01); *E04F 21/16* (2013.01); *E04F 15/126* (2013.01)

(58) Field of Classification Search
CPC ..... E04C 19/21; E04F 21/245; E01C 19/20
See application file for complete search history.

(56) References Cited

U.S. PATENT DOCUMENTS

| | | | | |
|---|---|---|---|---|
| 2,556,983 A | | 6/1951 | Root | |
| 2,662,454 A | | 12/1953 | Whiteman | |
| 2,963,059 A | | 12/1960 | Grub | |
| 3,452,381 A | * | 7/1969 | Bratti | E04F 21/248 15/230.16 |
| 3,686,703 A | * | 8/1972 | Ray | E04F 21/22 15/235.4 |
| 3,823,516 A | | 7/1974 | Christian | |
| 4,271,557 A | | 6/1981 | Caron | |

(Continued)

FOREIGN PATENT DOCUMENTS

WO WO-2008/065210 A1 6/2008

OTHER PUBLICATIONS

Diamond Tool Supply, Inc., "Floor Maintenance and Cleaning—Vortex" Catalog, (published on or before May 2013).

(Continued)

*Primary Examiner* — Cachet I Sellman
(74) *Attorney, Agent, or Firm* — Harness, Dickey & Pierce, P.L.C.

(57) ABSTRACT

Methods and apparatus are provided for finishing a composite floor. The apparatus includes a grouting pan configured to be affixed to the rotating head of a finishing machine. The grouting pan has a planar bottom surface and a curved sidewall. Grouting pans are rotated over a prepped surface such that the curved sidewalls trowel the mortar onto the rough composite surface and the bottom surface which is in contact with the prepped floor forces the mortar into the surface voids such that a grouted surface.

31 Claims, 4 Drawing Sheets

(56) References Cited

U.S. PATENT DOCUMENTS

| | | | | |
|---|---|---|---|---|
| 4,502,174 | A | 3/1985 | Rones | |
| 4,724,567 | A | 2/1988 | Rones | |
| 4,781,556 | A | 11/1988 | Paul | |
| 4,939,872 | A | 7/1990 | Revelin et al. | |
| 5,054,245 | A | 10/1991 | Coty | |
| 5,170,595 | A | 12/1992 | Wiand | |
| 5,174,795 | A | 12/1992 | Wiand | |
| 5,372,452 | A * | 12/1994 | Hodgson | E04F 21/248 404/112 |
| 5,449,406 | A | 9/1995 | Presti, Jr. | |
| D367,743 | S | 3/1996 | Krause et al. | |
| 5,567,503 | A | 10/1996 | Sexton et al. | |
| 5,605,493 | A | 2/1997 | Donatelli et al. | |
| 5,607,345 | A | 3/1997 | Barry et al. | |
| 5,632,570 | A | 5/1997 | Balling | |
| 5,807,022 | A * | 9/1998 | McCleary | E04F 21/20 404/101 |
| 5,882,249 | A * | 3/1999 | Ferland | E04F 21/248 451/359 |
| 5,970,559 | A | 10/1999 | Christy | |
| 6,234,886 | B1 | 5/2001 | Rivard et al. | |
| 6,371,542 | B1 | 4/2002 | Romero | |
| 6,625,951 | B1 * | 9/2003 | McCarthy | E04D 11/007 156/297 |
| D510,850 | S | 10/2005 | Boler, Jr. | |
| 7,004,676 | B2 | 2/2006 | Williams | |
| 7,033,258 | B2 | 4/2006 | Jordan | |
| 7,059,801 | B2 | 6/2006 | Snyder et al. | |
| 7,144,194 | B2 * | 12/2006 | Kipp, Jr. | E04F 21/248 404/112 |
| 7,147,548 | B1 | 12/2006 | Mehrabi | |
| 7,172,365 | B2 * | 2/2007 | Lutz | E04F 21/248 404/112 |
| 7,204,745 | B2 | 4/2007 | Thysell | |
| D559,063 | S | 1/2008 | Okamoto et al. | |
| D576,855 | S | 9/2008 | Okamoto et al. | |
| D581,237 | S | 11/2008 | Okamoto et al. | |
| D584,591 | S | 1/2009 | Tano et al. | |
| 7,506,544 | B2 | 3/2009 | Park | |
| D592,029 | S | 5/2009 | Tano et al. | |
| D592,030 | S | 5/2009 | Tano et al. | |
| D600,989 | S | 9/2009 | Tano et al. | |
| 7,674,069 | B2 * | 3/2010 | Stenzel | E04F 21/247 404/112 |
| 7,713,109 | B2 | 5/2010 | Estes | |
| 7,815,393 | B2 | 10/2010 | Snyder et al. | |
| 7,997,960 | B2 | 8/2011 | Williams, Sr. | |
| 8,176,909 | B2 | 5/2012 | Ilgner | |
| 8,192,255 | B2 | 6/2012 | Gallup et al. | |
| D678,745 | S | 3/2013 | Nguyen | |
| D694,081 | S | 11/2013 | Wright | |
| 8,790,164 | B2 | 7/2014 | Rivard et al. | |
| D731,448 | S | 6/2015 | Kinoshita et al. | |
| D732,917 | S | 6/2015 | Valentini | |
| 9,050,625 | B1 * | 6/2015 | Bonachea Ruiz | B05D 3/12 |
| 9,174,326 | B2 | 11/2015 | Ahonen | |
| 9,580,916 | B2 | 2/2017 | Tchakarov et al. | |
| 2003/0029132 | A1 * | 2/2003 | Ward | E04D 1/36 52/742.16 |
| 2005/0172428 | A1 | 8/2005 | Thysell | |
| 2005/0227600 | A1 | 10/2005 | Fisher | |
| 2006/0073776 | A1 | 4/2006 | Gallup | |
| 2007/0254568 | A1 | 11/2007 | Park | |
| 2008/0108286 | A1 | 5/2008 | Thysell et al. | |
| 2008/0176498 | A1 | 7/2008 | Rossi et al. | |
| 2010/0240282 | A1 | 9/2010 | Young | |
| 2011/0300784 | A1 | 12/2011 | Tchakarov et al. | |
| 2013/0000246 | A1 * | 1/2013 | Bourelle | E04F 21/162 52/745.21 |
| 2013/0225051 | A1 | 8/2013 | Vankouwenberg | |
| 2013/0324021 | A1 | 12/2013 | Ryan | |
| 2016/0083967 | A1 | 3/2016 | Tchakarov et al. | |

OTHER PUBLICATIONS

Diamond Tool Supply, Inc., "Tools for Concrete" Catalog, (published on or before May 2013).

Diamond Tool Supply, Inc., "Floor Maintenance and Cleaning—Monroe" Catalog, (published prior to Sep. 2014).

Diamond Tool Supply, Inc., "Tools for Stone" Catalog, (published prior to Sep. 2014).

Diamond Tool Supply, Inc., "Tools for Concrete" Catalog, (published prior to Sep. 2014).

HTC, "Professional Floor Systems" Product catalog 2014, www.htc-floorsystems.com, 2014.

HTC, "Professional Floor Systems" Product catalogue 2015, www.htc-floorsystems.com, 2015.

Wagman Metal Products Inc., "Concrete Finishing Tools" Catalog, (published prior to Sep. 23, 2016).

* cited by examiner

METHOD FOR FINISHING A SURFACE USING A GROUTING PAN

CROSS-REFERENCE TO RELATED APPLICATIONS

This application is a divisional of U.S. patent application Ser. No. 14/490,012 filed Sep. 18, 2014, issued as U.S. Pat. No. 9,580,916. The entire disclosure of the above application is incorporated by reference herein.

FIELD

The present disclosure relates generally to finishing of composite surfaces, and more particularly relates to a method for filing voids and/or pin holes in the composite surface and grouting pans for use in the method.

BACKGROUND

This section provides background information related to the present disclosure which is not necessarily prior art.

Composite surfaces such as epoxy, terrazzo, or cementitious floors generally include a decorative aggregate most commonly marble chips but also g or any suitable aggregate supported in a matrix material. First, a solid, level foundation typical of concrete is established. Next, a subflooring layer is formed on top of the foundation. Historically, this layer is a sandy concrete layer. Metal divider strips may be partially embedded in the concrete before it cures to provide panels in the surface. Finally, a top layer including the matrix material with the decorative aggregate is placed into each of the panels. Historically, the matrix material was a cementitious material but now may be a polymer-based matrix such as epoxy-based. The matrix material may be color-pigmented. The decorative aggregate, while typically marble chips, may be any suitable aggregate e.g., glass, porcelain, concrete, metal, mother of pearl, abalone. While the mixture is still wet, additional aggregate may be broadcast into various panels. Finally, the entire surface is rolled with a weighted roller.

As initially installed, these composite surfaces are porous or semi-porous in nature. Moreover, as the composite surface dries in the case of a cementitious matrix or cures in the case of polymer-based matrix, gases are released from the matrix causing surface imperfections, pin-holes and subsurface voids in the top layer. To address this concern, the top layer is rough cut using very course to course (24-grit to 80-grit) grinding stones or diamond plates. Rough cutting the top layer evens out the surface imperfections but may leave slight depressions. Rough cutting does little to remedy the pin holes and may open up subsurface voids to the surface. If left untreated, these flaws can collect excess wax, dirt and other debris which affects the look and surface quality of the composite surface.

Accordingly, it is necessary to grout the composite surface in an effort to fill the remaining surface imperfections. The rough cut layer is grouted by hand trowelling a mortar onto the composite surface. The mortar is repeatedly wiped back and forth over the surface with a hand trowel. As the trowel approaches a surface imperfection, the mortar covers the indentations and partially fills the subsurface voids. However, as the trowel moves past the surface imperfection, the trowel can pull mortar out of the subsurface void, thus leaving surface imperfections. Even subsurface voids that have been covered with mortar may become exposed as the mortar dries or cures.

Accordingly, it is desirable to develop a method of grouting a rough cut floor which completely fills the surface imperfections. In addition, it is desirable to develop a tool useful in the grouting process and which is configured for use on the finishing machines typically used in conventional grinding and polishing of composite surface. Furthermore, other desirable features and characteristics of the present invention will become apparent from the subsequent detailed description of the invention and the appended claims, taken in conjunction with the accompanying drawings and this background of the invention.

SUMMARY

In one embodiment, an apparatus in the form of a grouting pan is provided for grouting a composite surface. The grouting pan includes a substantially planar bottom surface and a curved sidewall surrounding the bottom surface. The curved side wall has an angled portion and a rounded edge portion formed between the bottom surface and the angled portion such that an obtuse included angle is formed therebetween. A top surface is configured to affix the grouting pan to a rotating head of a finishing machine.

In another embodiment, an apparatus in the form of a grouting pan assembly is provided for grouting a composite surface. The grouting pan assembly includes a carrier having a first face configured to affix the grouting pan assembly to a rotating head of a finishing machine and a second face opposite the first face with a plurality of grouting pans extending therefrom. Each grouting pan includes a substantially planar bottom surface and a curved sidewall surrounding the bottom surface. The curved side wall has an angled portion and a rounded edge portion formed between the bottom surface and the angled portion such that an obtuse included angle is formed therebetween. A top surface is configured to affix the grouting pan to a rotating head of a finishing machine.

In a further embodiment a method is provided for finishing a composite surface. The method includes spreading a mortar over a rough composite surface having surface voids to form a prepped surface. A grouting pan having a curved sidewall extending from a generally flat bottom surface in contact with the prepped floor is rotated over the prepped surface. By way of the rotary movement, the grouting pans are moved in different directions relative to the composite surface so that they are pushed across the surface imperfection composite surface. In doing so, the grouting pans force trapped air out of and mortar into of the pin holes and surface voids. In particular, the sidewall push the mortar into the surface imperfections, while the rounded edge and the planar bottom surface compress the mortar in and force air out. This action also thoroughly mixes any filler with the mortar during grouting. The cured surface is finished to form a finished surface.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. There is no intention to be limited by any principle presented in the preceding background or the following detailed description.

Figure 1:
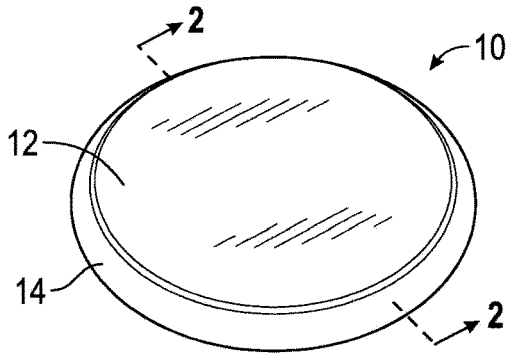
FIG. 1 is a perspective view of a grouting pan.
Figure 2:
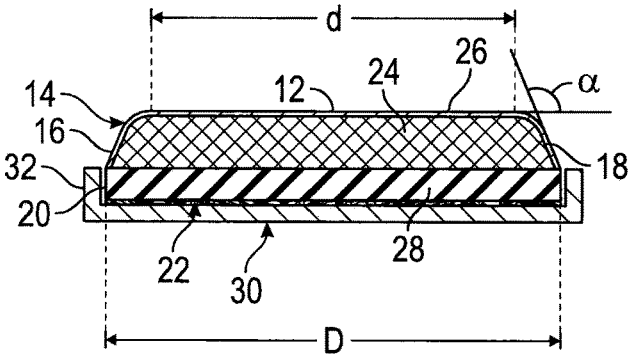
FIG. 2 is a cross-sectional view of the grouting pan shown in FIG. 1.
Figure 3:
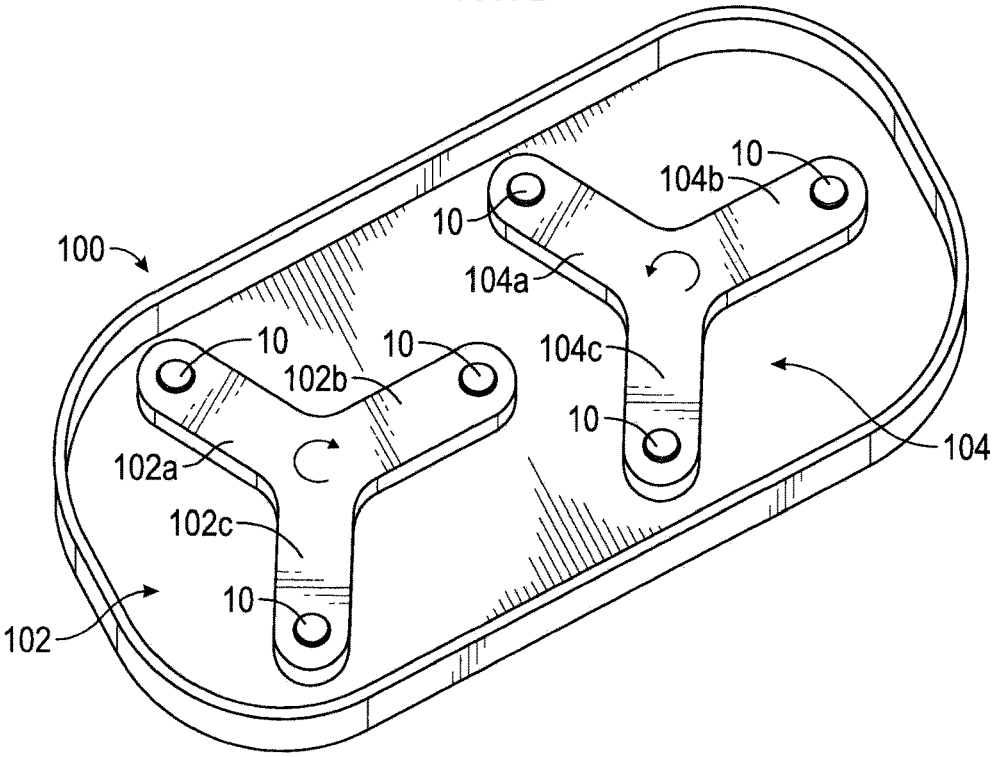
FIG. 3 is a top view showing several grouting pans affixed to a counter-rotating head of a finishing machine.

With reference now to FIGS. 1 and 2, a grouting pan 10 for finishing a composite surface is disclosed. The grouting pan 10 has a substantially planar bottom surface 12, and a curved sidewall 14 surrounding the bottom surface 12. The curved sidewall 14 is defined by an angled portion 16 and a rounded edge portion 18. The curved sidewall 14 may further include a vertical portion 20 extending from the angled portion 16 to a top surface 22. The surface 22 formed on the grouting pan 10 is configured to affix the grouting pan 10 to a rotating head 100 of a finishing machine (not shown) as best seen in FIG. 3. For example, the top surface 22 may be configured to hook or loop material that secures with a corresponding loop or hook material on the rotating head 100.

With specific reference to FIG. 2, the grouting pan 10 includes an inner body 24 supporting a thin-walled outer shell 26. In a preferred embodiment, the thin-walled shell 26 is a metal shell, most preferably stainless steel. The grouting pan 10 may optionally include an intermediate layer 28 disposed between the inner body 24 and the top surface 22. An outer edge of the intermediate layer 28 may define the vertical portion 20 of the curved sidewall 14. The intermediate layer 28 is preferably a compliant material such as rubber or a similar polymeric material and resiliently supports the inner body 24 and the shell 26 from the top surface 22. Optionally, the grouting pan 10 may include a retainer 30 having a rim 32 extending from the top surface 22 towards the bottom surface 12 and surrounding a portion of the sidewall 14.

As presently preferred, the geometry of the grouting pan 10 is configured to efficiently spread mortar over the rough cut layer. In one embodiment, the grouting pan 10 is generally frusto-conical in shape having a top surface 22 with a diameter (D) of about 80 mm and a bottom surface 12 with a diameter (d) of about 64 mm. The height of the sidewall 14 (measured perpendicular to the bottom surface) is about 10 mm. The thickness of the intermediate layer 28 is about 6 mm. The included angle ($\alpha$) is in the range of 100°-135°, and preferably in the range of 110°-120°. The rounded edge has a radius (R) of at least 4 mm and preferably greater than or equal to 6 mm.

With particular reference to FIG. 3, the grouting pan 10 shown in FIGS. 1 and 2 is well suited for use on a finishing machine 100 having heads 102, 104. For example, a grouting pan 10 is affixed at the end of each leg 102*a*, 102*b*, 102*c* of rotating head 102 which rotates in a clockwise direction. Additional grouting pans 10 may be affixed to the rotating head 102 at a position radially inward from the grouting pans 10 shown on the legs 102*a-c*. Similarly, a grouting pan 10 is affixed at the end of each leg 104*a*, 104*b*, 104*c* of counter-rotating head 104 which rotates in a counter-clockwise direction. Additional grouting pans 10 may be affixed to the counter-rotating head 104 at a position radially inward from the grouting pans 10 shown on the legs 102*a-c*. During operation of the finishing machine, the heads 102, 104 rotate the grouting pans 10 over the prepped surface for troweling the mortar onto the rough composite surface with the sidewalls 14 and forcing the mortar into the surface voids with the bottom surface 12 to form a grouted surface.

Figure 4:
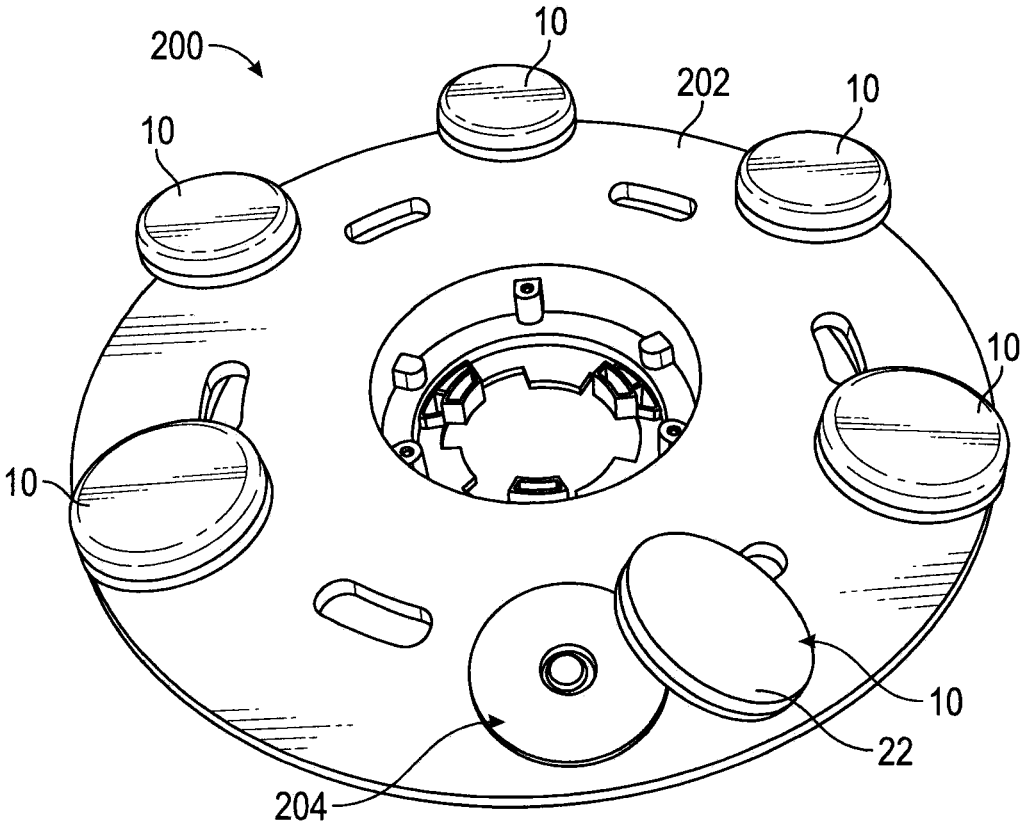
FIG. 4 is a top view showing several grouting pans affixed to a rotating head of a floor buffer or swing machine.

With particular reference to FIG. 4, the grouting pan 10 shown in FIGS. 1 and 2 are also well suited for use on a floor buffer or swing machine 200 having a rotary head 202. For example, multiple grouting pans 10 (six being shown) are affixed to a support 204 extending from the rotary head 202. The support 204 is configured with a fastener (e.g., a hook surface) that is complementary to the fastener (e.g., a loop surface) on the top surface 22 of the grouting pan. Additional grouting pans 10 may be affixed to the rotary head 202 as needed for a particular application. During operation of the finishing machine, the head 202 rotates the grouting pans 10 over the prepped surface for troweling the mortar onto the rough composite surface and forcing the mortar into the surface voids to form a grouted surface.

Figure 5:
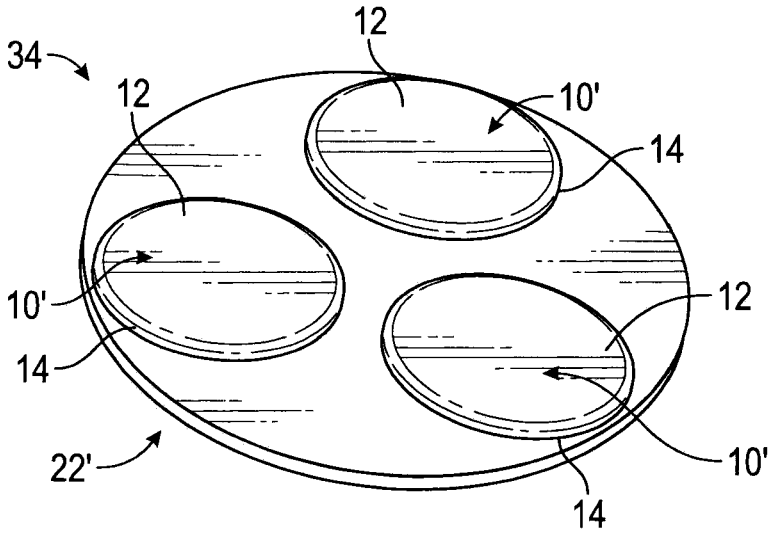
FIG. 5 is a perspective view of a grouting pan assembly having three grouting pans.
Figure 6:
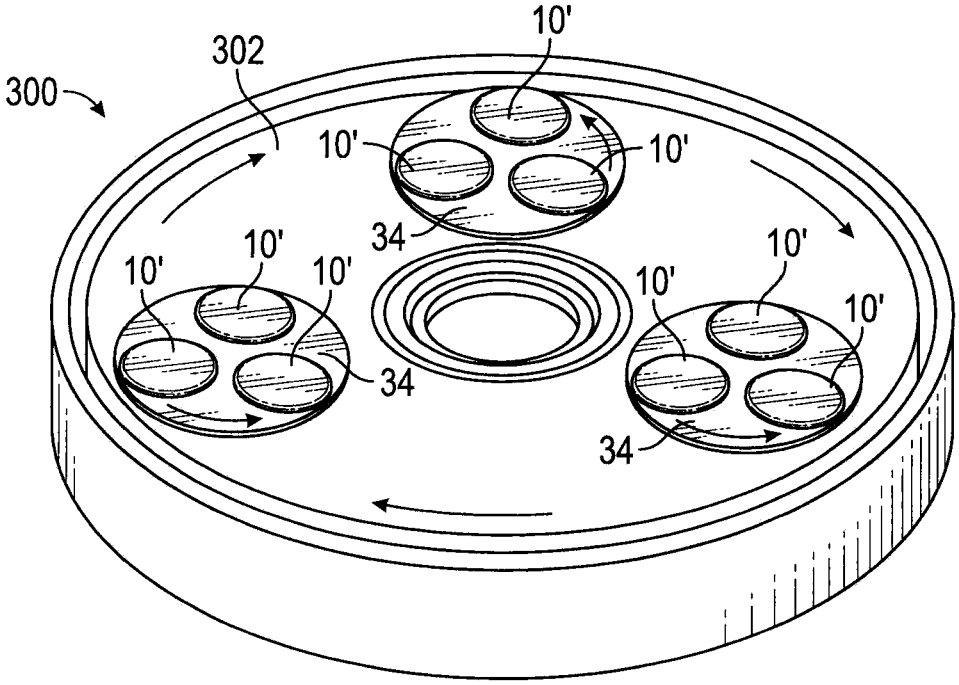
FIG. 6 is a top view showing several grouting pans affixed to a planetary head of the finishing machine.

With reference now to FIGS. 5 and 6, a grouting pan assembly 34 is illustrated as including three grouting pans 10' extending from a carrier 36. While three grouting pans 10' are illustrated herein, one skilled in the art will recognize that the number of grouting pans 10' is not limited to three and may include a plurality of grouting pans extending from the carrier 36. In this regard, the grouting pans 10' are structurally and functionally equivalent to but may be dimensionally different from the grouting pans 10 described above.

The carrier 36 provides sufficient surface area to accommodate the proscribed number of grouting pans. In this regards, the carrier 36 defines the top surface 22' configured to affix the grouting pan assembly 34 to a finishing machine 300 as best seen in FIG. 6. Furthermore, the carrier 36 may substitute for the intermediate layer 28 described above for resiliently supporting the grouting pans.

With particular reference to FIG. 6, the grouting pan assembly 34 shown in FIG. 5 is well suited for use on a finishing machine 300 having a rotary head 302 supporting a set of counter-rotating planets 304. For example, a grouting pan assembly 34 (three being shown) are affixed to the counter-rotating planet 304 which rotates in a direction opposite the rotary head 302. Additional grouting pan assemblies 34 may be affixed to counter-rotating planets 304 as needed for a particular application. During operation of the finishing machine, the head 302 rotate the grouting pan assemblies 10 in a clockwise direction as the planets 304 rotate each assembly 10 in a counterclockwise direction relative to the head 302 over the prepped surface for troweling the mortar onto the rough composite surface and forcing the mortar into the surface voids to form a grouted surface.

Figure 7:
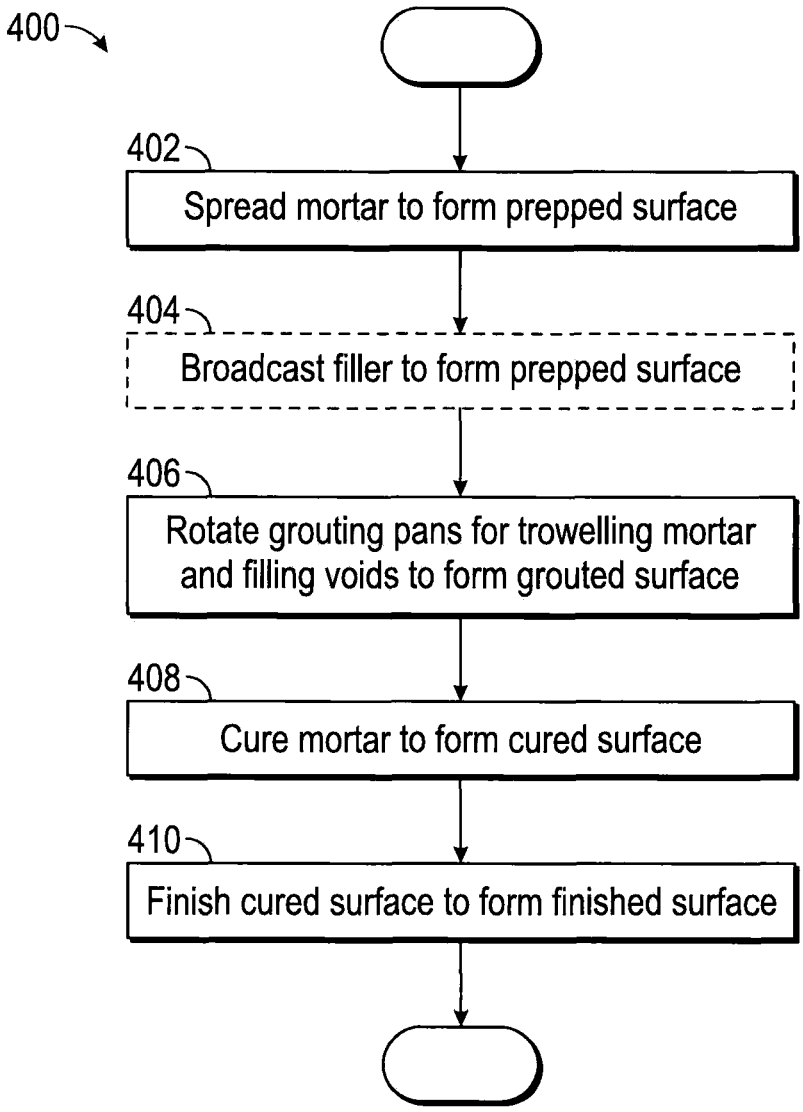
FIG. 7 is a flow-chart showing a method for finishing a composite floor using the grouting pans on the finishing machine.

With reference now to FIG. 7, a method 400 for finishing a composite surface will now be described. While the method described herein has a specific application for grouting a terrazzo floor, the process has broader utility for finishing or re-finishing any composite surface including but not limited to epoxy, terrazzo, or cementitious surface with or without decorative aggregates. Initially, it is understood that a rough composite surface has been prepared in accordance the conventional method described in the background above with the following exception. The method described hereafter, and in particular the method for grouting the rough composite surface enables the use of a finer grit during the rough cut process than the very course or course grit used in conventional finishing. In particular, the rough composite surface may be finished to a 150-grit or 200-grit surface prior to grouting.

The method 400 for finishing a composite surface include spreading a mortar over the rough composite surface having surface voids to form a prepped surface as shown at block 402. Optionally, a filler may be broadcast on top of the mortar when forming the prepped surface as shown at block 404. The filler may be a very fine powder of pulverized stone (e.g., marble, lime stone, granite and/or quartz), calcium carbonate or cement. Grouting pans are rotated over the prepped surface such that the curved sidewalls trowel the mortar onto the rough composite surface and the bottom surface 12 which is in contact with the prepped floor forces the mortar into the surface voids such that a grouted surface is formed at block 406. The mortar on the grouted surface is allowed to cure such that a cured surface is formed at block 408. Then, the cured surface is ground to remove excess grout and finished using to a fine grit finish on the order of 200-grit or higher, then sealed and polished such that a finished surface is formed at block 410. The grouting pans 10 described herein are particularly well suited for use on a rotating head 102, 202, 302 of a finishing machine 100, 200, 300 when practicing the method 400 described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method for finishing a composite surface comprising:
(a) spreading a mortar over a rough composite surface having surface voids to form a prepped surface;
(b) rotating a grouting pan over the prepped surface, the grouting pan having a curved sidewall extending from a rotary head for troweling the mortar onto the rough composite surface and a generally flat bottom surface in contact with the prepped floor for forcing the mortar into the surface voids to form a grouted surface;
(c) curing the grouted surface to form a cured surface; and
(d) finishing the cured surface to form a finished surface.

2. The method of claim 1, further comprising broadcasting a filler over the rough composite surface after spreading the mortar to form the prepped surface, wherein the grouting pan trowels the mortar and filler onto the rough composite surface and the bottom surface forces the mortar and filler into the surface voids to form the grouted surface.

3. The method of claim 1, further comprising rotating a plurality of the grouting pans over the prepped surface, wherein the plurality of grouting pans are configured to be affixed to a rotating head of a finishing machine.

4. The method of claim 1, further comprising rotating the grouting pan over the prepped surface and counter-rotating a second grouting pan over the prepped surface, wherein the grouting pans are affixed to a counter-rotating head of a finishing machine.

5. The method of claim 1, further comprising rotating a set of three of the grouting pans over the prepped surface, wherein the set of three grouting pans are affixed to a planetary rotating head of a finishing machine.

6. The method of claim 1, further comprising rough cutting the rough composite surface to a 150-grit finish prior to the spreading of the mortar.

7. The method of claim 6, wherein the finishing of the cured surface comprises finishing the cured surface to at least a 200-grit finish.

8. The method of claim 1, further comprising sealing and polishing the finished surface.

9. A method for finishing a floor surface comprising:
(a) affixing grouting pans to a finishing machine;
(b) rotating the grouting pans;
(c) spreading a mortar over the floor surface having voids;
(d) contacting the bottom surfaces of the rotating grouting pans with the floor surface while the grouting pans push the mortar into the voids;
(e) each of the plurality of grouting pans including a bottom surface and a sidewall surrounding the bottom surface; and
(f) the sidewall including a tapered portion and a rounded edge portion formed between the bottom surface and the tapered portion.

10. The method of claim 9, wherein the tapered portion has an included angle in the range of 110°-135° for each of the grouting pans.

11. The method of claim 9, wherein the rounded edge has a radius of at least 4 mm for each of the grouting pans.

12. The method of claim 9, wherein each of the grouting pans further comprises a generally circular inner body supporting a thin-walled outer shell.

13. The method of claim 9, wherein each of the grouting pans further comprises an intermediate layer resiliently located between an inner body and a rotatable member coupling the grouting pan to the finishing machine.

14. The method of claim 9, wherein each of the grouting pans further comprises a floor-contacting metallic shell including the bottom surface.

15. The method of claim 9, wherein the bottom surface of each of the grouting pans has a circular periphery.

16. The method of claim 9, further comprising:
a rotary head coupled to the machine;
at least three of the grouting pans being attached to a rotatable carrier;
the carrier being attached to the rotary head; and
rotating the carrier in a different direction than the head.

17. The method of claim 9, further comprising contacting the mortar with the rounded edge while performing the pushing of the mortar into the voids which are in the surface of a cured or dried composite or cement floor.

18. The method of claim 9, further comprising using a hook and loop fastening assembly to attach each of the grouting pans to the rotatable member.

19. The method of claim 9, further comprising:
using the grouting pans to mix a powered filler with the mortar; and
an outer diameter of the bottom is smaller than an outer diameter of a largest portion of the sidewall of each of the grouting pans.

20. The method of claim 9, wherein each of the grouting pans further comprises a compliant intermediate layer located between the bottom, which is metallic, and a rotatable carrier coupled to the machine.

21. The method of claim 9, further comprising rough cutting the rough composite surface to a 150-grit finish prior to the spreading of the mortar.

22. The method of claim 9, further comprising:

curing the mortar; and finishing the cured floor surface with at least a 200-grit.

23. A method for finishing a floor surface comprising:

(a) coupling a grouting pan to an aggregate floor-finishing machine;

(b) contacting a metallic bottom and a sidewall, both having circular peripheries, of the grouting pan to the floor surface, the grouting pan further comprising a compliant intermediate layer located on an opposite side of the bottom from the floor surface; and (c) rotating the grouting pan by the machine.

24. The method of claim 23, further comprising:

attaching the grouting-pan to a carrier as part of the coupling step; and rotating a head of the machine and the carrier in opposite directions.

25. The method of claim 24, further comprising:

coupling at least a second rotatable carrier to the head; and attaching at least a second grouting-pan to the second carrier.

26. The method of claim 23, further comprising:

attaching at least three of the grouting-pans to each of the carriers; and rotating multiple rotatable carriers and an attached head of the machine in a planetary manner.

27. The method of claim 23, further comprising troweling the mortar onto the cured or dried floor surface with the sidewall and bottom of the grouting-pan while forcing the mortar into surface voids of the floor surface.

28. The method of claim 23, further comprising coupling a retainer, including a peripherally projecting rim, to the grouting-pan.

29. The method of claim 23, wherein the floor-finishing machine is a floor buffer with the grouting-pan retrofit to a rotary head thereof, and the grouting-pan is stainless steel.

30. The method of claim 23, wherein the floor-finishing machine is a floor grinding machine with the grouting-pan retrofit to a rotary head thereof, and the grouting-pan is stainless steel.

31. The method of claim 23, further comprising using the grouting pan to mix a powdered filler into the mortar.

* * * * *